US007481627B2

(12) United States Patent
Beckman

(10) Patent No.: US 7,481,627 B2
(45) Date of Patent: Jan. 27, 2009

(54) AIR COMPRESSOR TOOLS THAT COMMUNICATE WITH AN AIR COMPRESSOR

(75) Inventor: Kurt Beckman, Springfield, MN (US)

(73) Assignee: MAT Industries LLC, Lincolnshire, IL (US)

( * ) Notice: Subject to any disclaimer, the term of this patent is extended or adjusted under 35 U.S.C. 154(b) by 497 days.

(21) Appl. No.: 10/929,926

(22) Filed: Aug. 30, 2004

(65) Prior Publication Data

US 2006/0045752 A1 Mar. 2, 2006

(51) Int. Cl.
*F04B 49/06* (2006.01)
*F04B 39/10* (2006.01)
*E21B 15/04* (2006.01)

(52) U.S. Cl. ..... 417/44.1; 417/313; 173/2

(58) Field of Classification Search ..... 417/40, 417/44.1, 44.2, 313; 173/2, 171
See application file for complete search history.

(56) References Cited

U.S. PATENT DOCUMENTS

| | | | | |
|---|---|---|---|---|
| 3,581,501 | A | 6/1971 | Kruger | |
| 3,673,541 | A * | 6/1972 | Volinskie | 439/195 |
| 3,686,861 | A | 8/1972 | Cripe | |
| 3,950,946 | A | 4/1976 | Sakai et al. | |
| 4,038,532 | A | 7/1977 | Burris et al. | |
| 4,515,515 | A | 5/1985 | Segonne | |
| 4,602,484 | A | 7/1986 | Bendikson | |
| 4,614,089 | A | 9/1986 | Dorsey | |
| 4,622,503 | A | 11/1986 | Sundblom et al. | |
| 4,759,692 | A | 7/1988 | Morse | |
| 4,834,626 | A | 5/1989 | Prevosto | |
| 4,951,705 | A | 8/1990 | Carey et al. | |
| 4,967,781 | A | 11/1990 | Baron | |
| H1057 | H | 5/1992 | Regalia et al. | |
| 5,125,067 | A | 6/1992 | Erdman | |
| 5,238,371 | A | 8/1993 | Benckert | |
| 5,442,810 | A * | 8/1995 | Jenquin | 455/66.1 |
| 5,454,397 | A | 10/1995 | Miszczak | |
| 5,555,005 | A | 9/1996 | Pagnon | |
| 5,693,042 | A * | 12/1997 | Boiarski et al. | 606/10 |
| 5,713,724 | A | 2/1998 | Centers et al. | |
| 5,755,254 | A | 5/1998 | Carter et al. | |
| 5,775,885 | A | 7/1998 | Dreiman et al. | |
| 5,837,903 | A | 11/1998 | Weigand | |
| 5,879,145 | A | 3/1999 | Baumgartner | |
| 5,923,558 | A | 7/1999 | Fix, Jr. | |
| 6,056,521 | A | 5/2000 | Leu et al. | |
| 6,059,542 | A | 5/2000 | Chou | |

(Continued)

FOREIGN PATENT DOCUMENTS

| | | |
|---|---|---|
| EP | 0 449 628 A2 | 10/1991 |

(Continued)

*Primary Examiner*—Charles G Freay
(74) *Attorney, Agent, or Firm*—Greer Burns & Crain Ltd

(57) ABSTRACT

An air compressor utilizing an electronic control system. A pneumatically controlled regulator is provided for controlling output pressure for an air compressor. Digital gauges are provided on the air compressor to replace conventional mechanical gauges. A variable speed motor is used, which in turn varies the speed of the pump. Tools are provided for an air compressor that are capable of transmitting a signal to the air compressor indicating a desired pressure and/or motor speed at which the air compressor is to operate.

16 Claims, 9 Drawing Sheets

U.S. PATENT DOCUMENTS

| | | | | |
|---|---|---|---|---|
| 6,146,100 | A | 11/2000 | Broucke | |
| 6,186,191 | B1 | 2/2001 | Dornier et al. | |
| 6,213,731 | B1 | 4/2001 | Doepker et al. | |
| 6,216,719 | B1 * | 4/2001 | Meyer | 137/68.14 |
| 6,305,427 | B1 | 10/2001 | Priest, II | |
| 6,330,873 | B1 | 12/2001 | Letang et al. | |
| 6,353,178 | B1 | 3/2002 | Linhart | |
| 6,376,767 | B1 | 4/2002 | Knudsen et al. | |
| 6,470,683 | B1 | 10/2002 | Childs et al. | |
| 2002/0158102 | A1 * | 10/2002 | Patton et al. | 227/8 |
| 2003/0033823 | A1 | 2/2003 | Pham et al. | |
| 2004/0265134 | A1 * | 12/2004 | Iimura et al. | 417/38 |

FOREIGN PATENT DOCUMENTS

| | | | |
|---|---|---|---|
| EP | 0 701 916 | A2 | 3/1996 |
| EP | 1 067 282 | A2 | 1/2001 |
| JP | 07253081 | A | 10/1995 |
| JP | 9 317646 | | 12/1997 |
| JP | 2000 130871 | A | 5/2000 |
| JP | 2001 090673 | A | 4/2001 |
| JP | 2001 133054 | A | 5/2001 |
| WO | WO 93/01539 | | 1/1993 |
| WO | WO 95/28605 | | 10/1995 |
| WO | WO 96/34238 | | 10/1996 |
| WO | WO 01/12967 | A1 | 2/2001 |
| WO | WO 01/42660 | A1 | 6/2001 |
| WO | WO 02/25115 | A1 | 3/2002 |
| WO | WO 03/015990 | A1 | 2/2003 |

* cited by examiner

FIG. 6
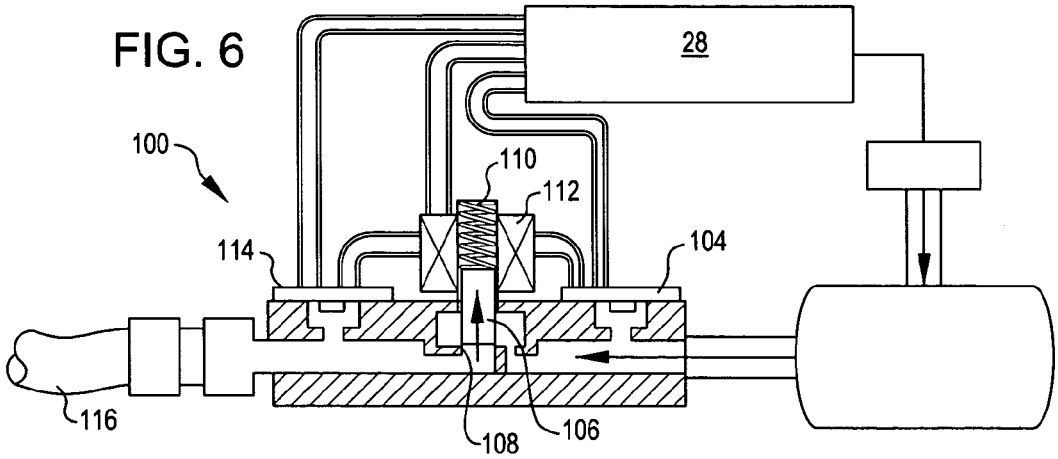
FIG. 7
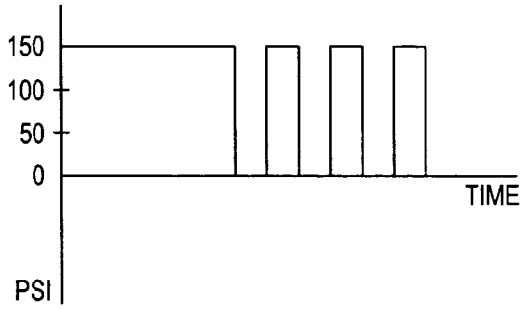
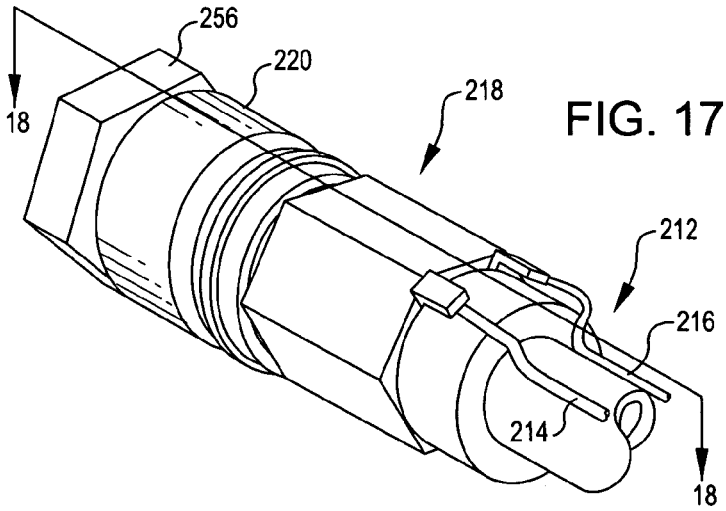
FIG. 17
FIG. 19
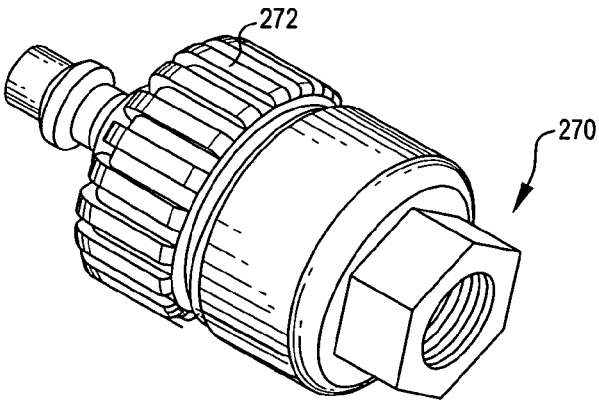

AIR COMPRESSOR TOOLS THAT COMMUNICATE WITH AN AIR COMPRESSOR

REFERENCE TO RELATED APPLICATIONS

The present invention is related to United States Patent Applications entitled "AIR COMPRESSOR UTILIZING AN ELECTRONIC CONTROL SYSTEM" Ser. No. 10/929,329 and "AIR COMPRESSOR WITH VARIABLE SPEED MOTOR" Ser. No. 10/929,280 having at least one common inventor, filed concurrently herewith, and hereby incorporated by reference in their entireties.

TECHNICAL FIELD OF THE INVENTION

The present invention relates generally to power tools, and more particularly to air compressors.

BACKGROUND OF THE INVENTION

Air compressors are becoming commonplace in home workshops. In general, an air compressor is a machine that decreases the volume and increases the pressure of a quantity of air by mechanical means. Air thus compressed possesses great potential energy, because when the external pressure is removed, the air expands rapidly. The controlled expansive force of compressed air is used in many ways and provides the motive force for air motors and tools, including pneumatic hammers, air drills, sandblasting machines, paint sprayers, and others.

A conventional home workshop air compressor includes a storage tank for compressed air, and a prime mover mounted on the compressor tank for compressing the air flowing into the compressor tank. The prime mover may be a gas engine or an electric motor, but most conventional home workshop models utilize electric power.

The basic components of an electric air compressor are an electric motor, a pump, a pressure switch, and a tank. The electric motor powers the pump. The pump compresses the air and discharges it into the tank. For conventional air compressors, compressed air from the pump is discharged through a tube and a check valve into the tank. The check valve prevents air from flowing out of the tank back through the tube when the compressor pump is not in operation. The tank stores the compressed air.

The pressure switch shuts down the motor and relieves air pressure in the pump and transfer tube when the air pressure in the tank reaches an upper level limit, or cut-out pressure. As the compressed air in the tank is used and the pressure level in the tank drops to a lower level limit, or cut-in pressure, the pressure switch restarts the motor automatically and the pump resumes compressing air.

Conventional air compressors include a tank pressure gauge that measures the pressure level of the air stored in the tank. This gauge is not adjustable by the operator, and does not indicate line pressure. A separate line pressure gauge is provided for indicating the output pressure. An air pressure regulator is provided to allow a user to adjust line pressure to the tool that is being used. In conventional home style or workshop air compressors, the air pressure regulator utilizes a fixed rate spring and a variable knob. By screwing the knob inward, the force the fixed spring applies to the regulation valve increases. This increase of force opens the regulation valve and increases the output of pressure of the air compressor.

Although conventional air compressors work well for their intended purpose, the existence of both the tank pressure and line pressure gauges may be confusing to a new user. The variable knob and fixed rate spring may also be confusing, and may be difficult to adjust to a desired output pressure.

Another problem inherent in the design of the mechanical gauges is that the gauges are susceptible to vibration, which all air compressors have. The amplitude of the vibration varies with the design of the compressor. Vibration sometimes makes the mechanical pressure gauges on conventional air compressors difficult to read.

One downside to electrical air compressors is that they must be designed to operate at conventional circuit levels. Most electrical air compressors operate on standard household electrical circuits that in the United States are typically rated at 120 volts and 15 amps. Less common but still applicable are 120 volts, 20 amp, and 240 volt, 15 amp circuits. To prevent overload, air compressors are designed to operate at their maximum load point within the least common denominator of these circuits.

Designing a conventional air compressor within the limits of existing circuits can cause limitations in the performance of a conventional air compressor. Conventional air compressors have fixed speed motors. A typical operating characteristic of conventional air compressors, because they have fixed speed motors, is that the load on the motor varies as the machine runs through its operating pressure. While the pump operates at nearly the same speed throughout its range of operation, the load on the motor varies significantly. Higher pressures require more power to run the pump, and result in loading the motor to higher horsepower levels. The higher horsepower levels correspond to increased amperage. The air compressor must be designed so that it can operate at the increased amperage level without tripping a circuit. Since the air compressor is limited to an electric circuit of a certain size, the overall performance of the machine is limited based on the peak amperage used at the maximum load.

Due to manufacturing tolerances causing some degree of variation in the load from air compressor to air compressor, most conventional air compressors are not designed at the absolute maximum performance (i.e., 15 amps). As in conventional fixed speed air compressors, the nominal rating would be somewhat less so that all machines would fall within an acceptable range, such as 14.2 to 14.9 amps. Thus, many air compressors are not capable of drawing amps that are available for the air compressor.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a pneumatically controlled regulator is provided for controlling output pressure for an air compressor. In an embodiment, the pneumatically controlled regulator utilizes a pneumatic controller that provides air on the back side of a cylinder for a regulator. Varying the air pressure provided by the pneumatic controller provides a similar function to the fixed rate spring and variable knob of prior art regulator designs. Thus, the pneumatic controller functions as an air spring. By increasing or decreasing the air pressure on the back side of the piston for the regulator, the pneumatic controller can control the pressure in the cylinder and thus control the output pressure of the air compressor. In an embodiment, the air pressure is controlled electronically via an easily understood user interface.

In accordance with an embodiment, an electronically simulated regulator may be provided to control output pressure of the air compressor. In an embodiment, the electronically simulated regulator utilizes a solenoid valve that is closed and opened via a pulse width modulation signal. The solenoid valve is rapidly opened and closed in accordance with the pulse width modulation signal so as to allow air from the tank to be provided as output pressure of the air compressor. The pulse width modulation signal is varied so that the average pressure over time equals the desired pressure.

In accordance with an embodiment, an air compressor includes digital gauges to replace conventional mechanical gauges. In addition, a user interface for the air compressor may include presets for selected operating pressures, an indicator to show what operating pressure at which the air compressor is operating, and/or pressure selector buttons for increasing or decreasing the pressure. The digital display may show both regulator and tank pressure, or may be switched to show only one, eliminating confusion for many users.

In accordance with another embodiment, an air compressor may include a variable speed motor, which in turn varies the speed of the pump. Varying the speed of the motor permits the motor to operate at its maximum potential at all pressures. In addition, noise produced by the compressor is directly proportional to the speed of the pump; thus, by varying the speed of the pump, the noise produced may be minimized at all pressures. User interface controls may be provided for varying the motor speed, or for setting a particular operation of the motor, such as maximum mode, quiet mode, or optimum mode. In maximum mode, the motor draws the maximum amperage available. In quiet mode, the motor runs below maximum amperage but at a sufficient speed to produce sufficient pressure, and at optimum mode the motor runs at a speed to maintain the tank at a pressure just above or equal to the pressure set by a user.

In accordance with an embodiment, tools are provided for an air compressor that are capable of transmitting a signal to the air compressor indicating a desired pressure and/or motor speed at which the air compressor is to operate. The tool may send the signal via a wireless connection, such as via infrared or radio frequency signals or, in an embodiment, may transfer the signal through a signal carrying pneumatic hose. If a signal carrying pneumatic hose is utilized, wires may extend along the hose, such as a neutral wire and a hot wire. The wires may terminate at couplings at opposite ends of the hose. Each wire is provided a contact that makes a connection with another contact on a plug at the tool (one end) and the air compressor (the opposite end).

In an embodiment, the signal provided by the tool is a resistance provided by the tool in a circuit that includes a resistor. The air compressor utilizes a lookup table to determine the necessary operating functions of the air compressor with respect to the resistance provided by the tool. In an embodiment, the tool may include a rheostat that allows the user to vary the resistance and thus change the operation of the air compressor.

Other features of the invention will become apparent from the following detailed description when taken in conjunction with the drawings, in which:

BRIEF DESCRIPTION OF THE DRAWINGS

FIG. 6 is a diagrammatic view of an alternate embodiment of a electronically simulated regulator that may be used to control output pressure of the air compressor of FIG. 1 in accordance with an embodiment;

FIG. 7 is a graph indicating pressure versus time for the electronically simulated regulator of FIG. 6 in accordance with one embodiment;

FIG. 17 is an assembled view of the coupler of FIG. 16;

FIG. 19 is a perspective view of a plug incorporating a variable signal generator in accordance with an embodiment of the invention;

DETAILED DESCRIPTION

In the following description, various embodiments of the present invention will be described. For purposes of explanation, specific configurations and details are set forth in order to provide a thorough understanding of the embodiments.

However, it will also be apparent to one skilled in the art that the present invention may be practiced without the specific details. Furthermore, well-known features may be omitted or simplified in order not to obscure the embodiment being described.

Figure 1:
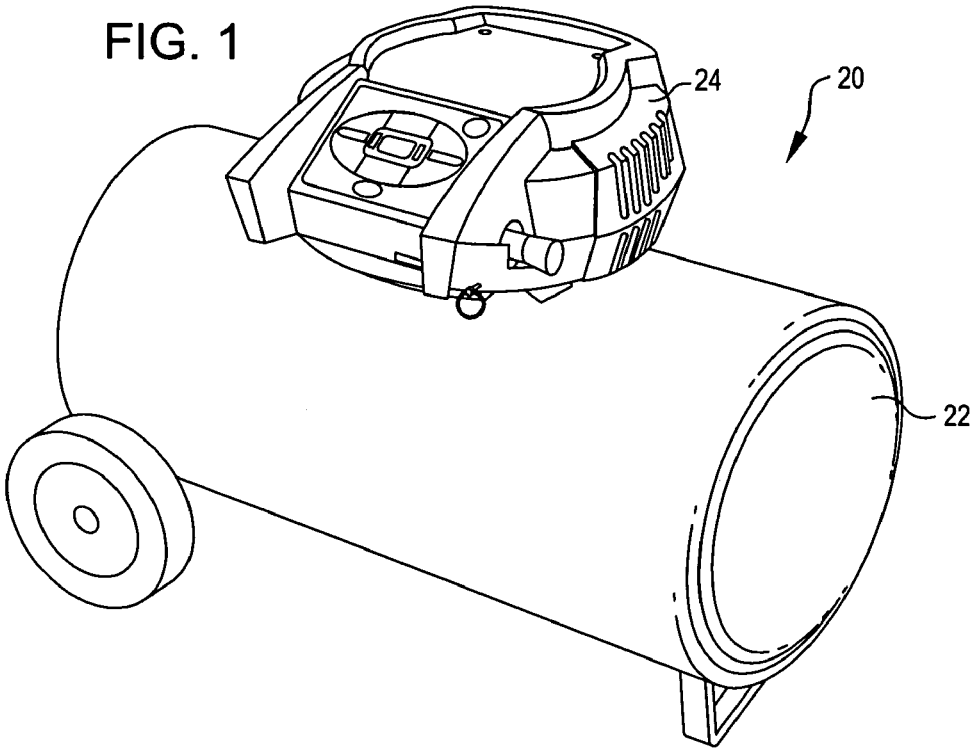
FIG. 1 is a perspective view showing an air compressor incorporating aspects of the present invention.
Figure 2:
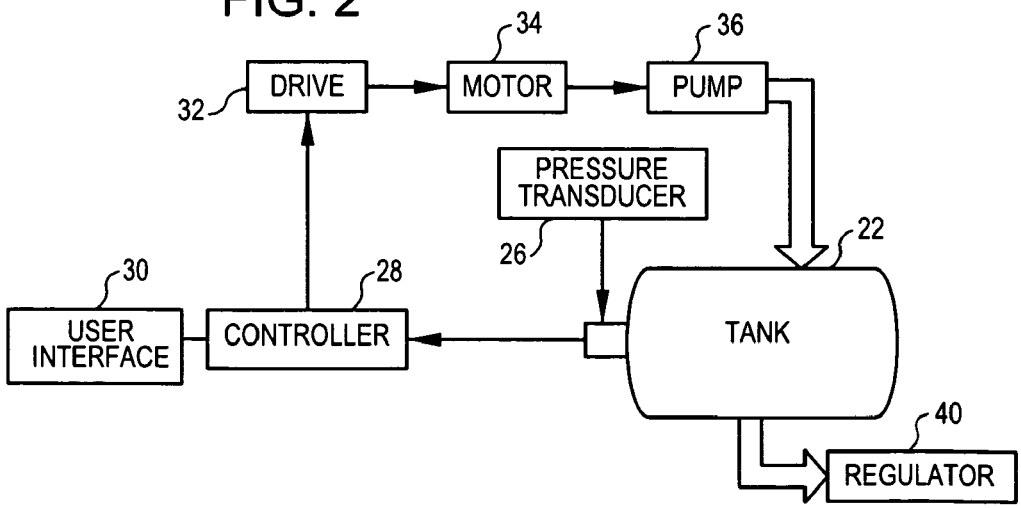
FIG. 2 is a diagrammatic view of components of the air compressor of FIG. 1 in accordance with an embodiment.

Referring now to the drawings, in which like reference numerals represent like parts throughout the several views, FIG. 1 shows an air compressor 20 incorporating aspects of the present invention. The air compressor 20 includes a tank 22 with a shroud 24 mounted thereon. Internal components are mounted in the shroud 24, one embodiment of which is shown diagrammatically in FIG. 2.

The tank 22 for the air compressor 20 is, for example, a 20-gallon cylindrical compressor tank. The tank 22 shown in the drawings is oriented in a horizontal position. However, aspects of the present invention may be utilized for an air compressor having a compressor tank that is aligned vertically or in another direction. Moreover, the shape of the tank 22 is not critical, and may be cylindrical, pancake-shaped, or may have one of many other profiles.

Included among the internal components is a pressure sensor, such as a transducer 26, and a controller 28. A user interface 30 is connected to the controller 28. The controller 28 determines operation of a drive 32, which in turn determines operation of a motor 34. A pump 36 is connected to the motor 34 and to the tank 22.

In accordance with an embodiment, the controller 28 is connected to a pneumatic controller 38 (FIG. 3) and a regulator 40. In this embodiment, the pneumatic controller 38 and the regulator 40 are utilized to control output pressure of the air compressor 20.

Generally described, the pneumatic controller 38 is configured to provide air pressure to the regulator 40 and acts as an air spring for the regulator 40 to control air pressure provided by the regulator 40. In an embodiment, the pneumatic controller 38 is provided pressurized air by the tank 22, and as further described below, utilizes that pressurized air to control the pressure of air flowing out of the regulator 40. However, air pressure may be supplied to the pneumatic controller 38 from another air pressure source other than the tank 22, and may utilize a different configuration than the pneumatic controller 38 shown in the drawings.

In the embodiment shown in the drawings, the pneumatic controller 38 includes an input pressure gauge 42, such as a pressure transducer. An input solenoid valve 44 is positioned in fluid communication with the input pressure gauge 42 and is positioned to enclose an opening 45. A spring 46 biases the input solenoid valve 44 into contact with and closes the opening 45. A solenoid 48 is provided that is operable to open the input solenoid valve 44 to allow air to flow through the opening 45.

An internal pressure gauge 50 is provided in the pneumatic controller 38 and is in fluid communication with the opening 45. The internal pressure gauge 50 may also be a pressure transducer, but other gauges may be provided.

The solenoid 48, the input pressure gauge 42, and the internal pressure gauge 50 are configured so that operation of the solenoid is based upon pressure measured by the input pressure gauge. To this end, the input pressure gauge 42, the internal pressure gauge 50, and the solenoid 48 may be connected to the controller 28 for control thereby, or may otherwise be controlled.

An output solenoid valve 52 is in fluid communication with the internal pressure gauge 50 and is biased against an opening 53 by a spring 54. A solenoid 56 is provided for opening the output solenoid valve 52 against the spring 54. Opening the output solenoid valve 52 allows air to flow out of an outlet 58. The solenoid 56 and the internal pressure gauge 50 are configured so that operation of the solenoid 56 is based upon pressure measured by the internal pressure gauge.

The internal pressure gauge 50 is in fluid communication with a regulator conduit 60. The regulator conduit 60, in turn, is in fluid communication with a cylinder 72 of the regulator 40. A free floating piston 74 is mounted in the cylinder 72. The piston 74 may be a rigid structure or a flexible structure, such as a diaphragm. A hollow shaft 76 is connected to the free floating piston 74 and an opening 78 extends from the internal portion of the hollow shaft 76 to the opposite side of the free floating piston 74.

The hollow shaft 76 is positioned to engage a valve 80 in the regulator 40. The valve 80 is biased to close an opening 81 by a spring 82.

An air inlet conduit 84 is in fluid communication with the valve 80. The air inlet conduit 84 is connected to the tank 22 for providing pressurized air to the regulator 40. An air outlet 86 is connected in fluid communication with the cylinder 72 of the regulator 40.

In operation, an operating pressure for the air compressor 20 is set, for example via the user interface 30. As an example, a user may set an operating pressure of the air compressor 20 to be 60 pounds per square inch ("PSI") for the output pressure of the air compressor 20. The pneumatic controller 38 utilizes this information to provide the appropriate air pressure through the regulator conduit 60 to the regulator 40. As an example, the pneumatic controller 38 may set 59 PSI as a lower input pressure for the internal pressure gauge 50 and 61 PSI as an upper pressure for the internal pressure gauge 50. If pressure supplied by the regulator conduit 60 is below the inlet pressure (i.e., in this example, 59 PSI), then the internal pressure gauge 50 sends a signal to the solenoid 48 (e.g., through the controller 28) to open the input solenoid valve 44, increasing the pressure supplied to the regulator conduit 60. When the lower pressure is exceeded, the internal pressure gauge 50 sends a signal for the input solenoid 48 to close the input solenoid valve 44.

If the pressure supplied by the regulator conduit 60 exceeds the upper pressure threshold (e.g., in this example, 61 PSI), then the internal pressure gauge 50 instructs the solenoid 56 to open the output solenoid valve 52, allowing air to flow out of the outlet 58. In this manner, the two pressure gauges 42, 50 and the solenoids 48, 56 can maintain an appropriate pressure range within the regulator conduit 60.

The pressure in the regulator conduit 60 applies pressure against the upper portion of the free floating piston 74 in the regulator 40. If this pressure exceeds the pressure below the free floating piston 74, then the free floating piston 74 is biased downward, for example to the position shown in FIG. 3, causing the hollow shaft 76 to drive the valve 80 open, increasing air flow into the cylinder 72 and pressure on the back side of the free floating piston 74. This air flow continues into the cylinder 72 until equilibrium is slightly exceeded; i.e., until the pressure on the top of the free floating piston 74 is slightly less than the pressure on the bottom of the free floating piston 74.

Figure 3:
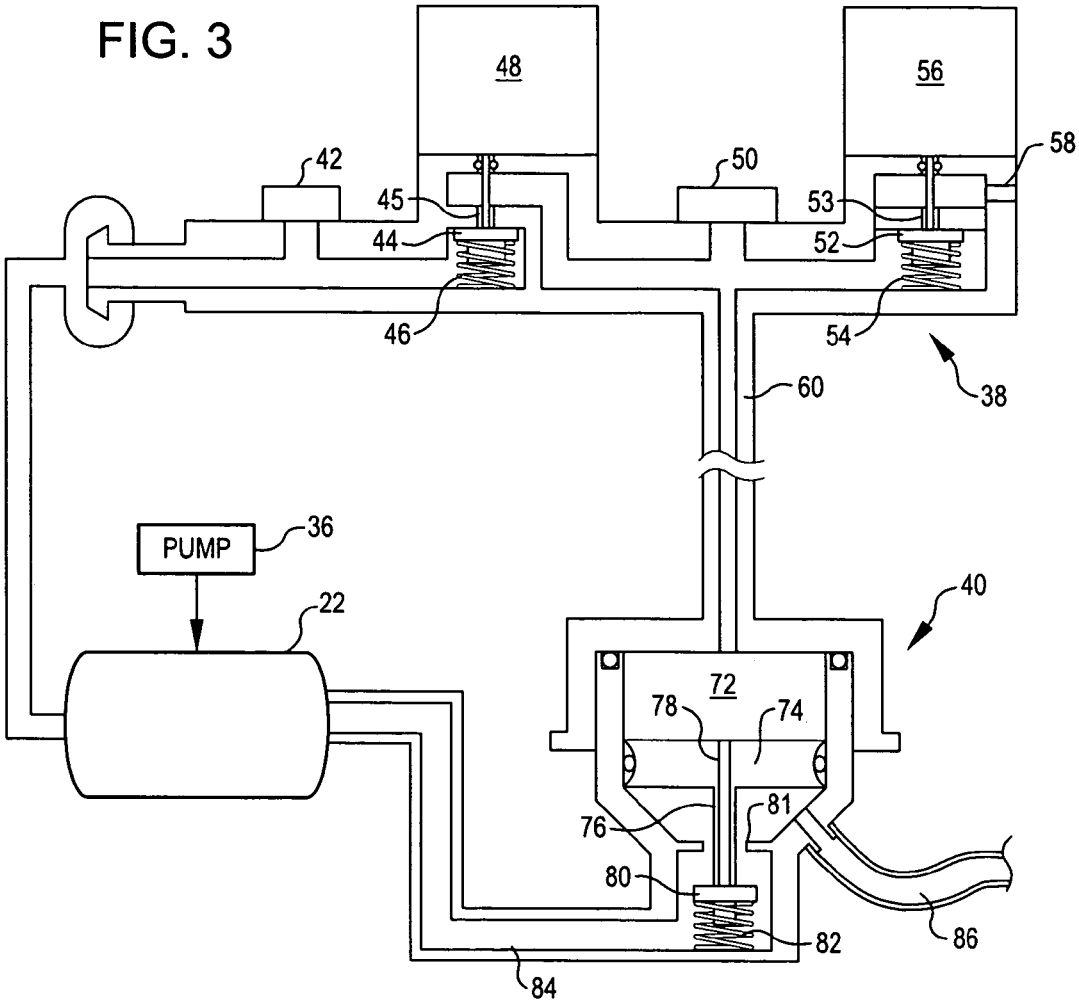
FIG. 3 is a diagrammatic view of a pneumatic controller and regulator that may be used with the air compressor of FIG. 1 in accordance with an embodiment.

When this happens, the free floating piston 74 is driven upward until the valve 80 closes the opening 81. At this point, equilibrium is reached between the pressure provided by the pneumatic controller 38 and the pressure on the underside of the free floating piston 74. In this manner, the outflow pressure out of the air outlet 86 is equal to the pressure set for the pneumatic controller 38. This position of the regulator 40 is shown in FIG. 3.

Figure 4:
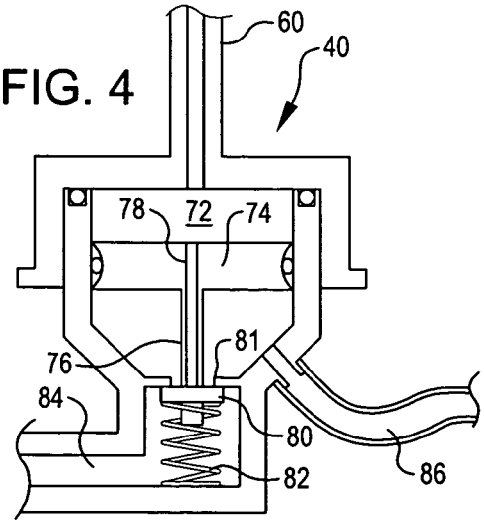
FIG. 4 is a diagrammatic view of the regulator of FIG. 3, with a valve for the regulator closed.
Figure 5:
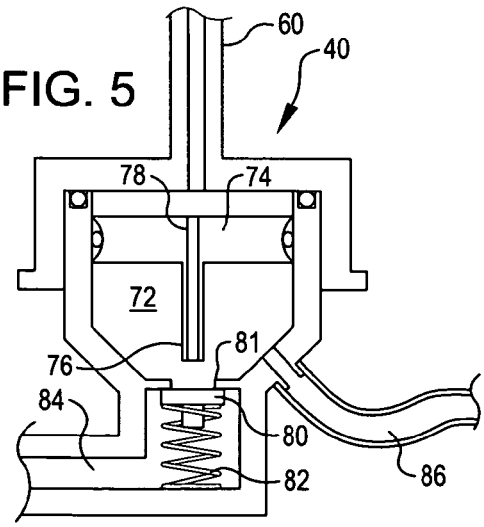
FIG. 5 is a diagrammatic view of the regulator of FIG. 3, with a valve for the regulator closed and a piston for the regulator raised.

If, after the valve 80 has been closed, the pressure on the bottom side of the free floating piston 74 exceeds the pressure on the top side of the free floating piston 74, then the free floating piston 74 is driven upward until the bottom portion of the hollow shaft 76 is unseated from the top of the valve 80. This position of the regulator 40 is shown in FIG. 5. In this position, air is free to flow through the hollow shaft 76 and out of the opening 78 in the free floating piston 74. This air potentially increases the pressure on the top side of the free floating piston 74 and in the regulator conduit 60. If this pressure causes the pressure to exceed the upper pressure for the internal pressure gauge 50, then the internal pressure gauge 50 can signal the solenoid 56 to open the output solenoid valve 52, allowing air to escape out of the outlet 58. This air may continue to escape until the air pressure returns to equilibrium on opposite sides of the free floating piston 74. As the pressure on the underside of the free floating piston 74 lowers, then the free floating piston 74 moves back downward to the position shown in FIG. 4. As stated above, this position is equilibrium, where the output pressure at the air outlet 86 is within the pressure range set by the pneumatic controller 38.

As can be understood, the pressure gauges 42, 50 may operate with the solenoids 48, 56 to continually approach equilibrium within the regulator 40. In this manner, the pneumatic controller 38 may set and maintain output pressure for the regulator 40.

An alternate embodiment of a controller for output pressure of the air compressor 20 is shown in FIG. 6. In this embodiment, an electronically simulated regulator 100 is placed in line between the tank 22 to control output pressure of the air compressor 20. The electronically simulated regulator 100 is connected to the controller 28. The controller 28 may operate the pump 36 and the motor 34 (not shown in FIG. 6). The electronically simulated regulator 100 includes an input pressure gauge 104 in fluid communication with the tank 22. A valve 106 is biased to close an opening 108 in fluid communication with the tank 22. The valve 106 is biased by a spring 110 to close the opening 108. A solenoid 112 is positioned to actuate the valve 106 against the bias of the spring 110 and to permit air to flow through the opening 108. An output pressure gauge 114 is in fluid communication with the opening 108. An outlet 116 is also in fluid communication with the opening 108.

In the embodiment shown, the controller 28 utilizes a pulse width modulation signal to operate the solenoid 112. The pulse width modulation signal sends rapid on and off signals to the solenoid 112, causing it to swiftly open and close.

The speed at which the solenoid 112 opens and closes the valve 106 and/or the amount of time the valve stays closed depends upon the desired output pressure of the electronically simulated regulator 100 and the pressure of the tank 22. The pressure of the tank 22 is measured by the input pressure gauge 104. A determination if the output pressure is at the desired level is made by the output pressure gauge 114.

In operation, the controller 28 sends a signal to open and close the solenoid 112 based upon information received by the input pressure gauge 104 and the output pressure gauge 114, utilizing an average of pressure supplied to the outlet 116 to determine the open and close rate of the solenoid 112.

For example, if the desired output pressure is 75 PSI and the tank pressure is 150 PSI, then the solenoid 112 is preferably open one-half of the time. By rapidly closing and opening the valve 106, the pressure supplied through the opening 108 is alternatingly 150 PSI and 0 PSI, averaging to 75 PSI. An initial period may be needed where the valve 106 is opened for an extended time to reach the desired pressure. By rapidly opening and closing the solenoid 112, the output pressure very closely approximates the average. In contrast, if long periods of delay were to occur between opening and closing of the valve 106, then bursts of high pressure and low pressure would be supplied to the outlet 116, which would be undesirable for a tool.

The amount of time that the solenoid 112 opens the valve 106, the amount of time the solenoid 112 keeps the valve 106 closed, and the gap between these times, may be controlled by the controller 28 to reach a desired output pressure. This output pressure may be monitored using the output pressure gauge 114. If the output pressure is much lower than the desired output pressure, then the printed circuit board 102 may instruct the solenoid 112 to average a pressure that is higher than the desired pressure. For example, if an output pressure of 60 PSI is desired, and the existing output pressure is 40 PSI, then the printed circuit board 102 may instruct the solenoid 112 to open the valve 106 half of the time (theoretically supplying 75 PSI, as described above). This pattern of opening and closing the solenoid 112 may be continued until the output pressure closely approximates the desired output pressure as indicated by the output pressure gauge 114. At this time, the solenoid 112 may be instructed to be open less of the time, for example 40 percent of the time, which is equal to the percentage of the tank pressure.

FIG. 7 shows a graph indicating pressure versus time for the electronically simulated regulator 100 in accordance with one example. In the example, the initial pressure supplied by the electronically simulated regulator 100 is a constant 150 PSI. The solenoid 112 is closed at that time, and then cycling of the solenoid 112 occurs to maintain an appropriate average. The time that the solenoid 112 maintains the valve 106 in an closed or opened position may also be varied to control the average pressure beyond this point.

Figure 8:
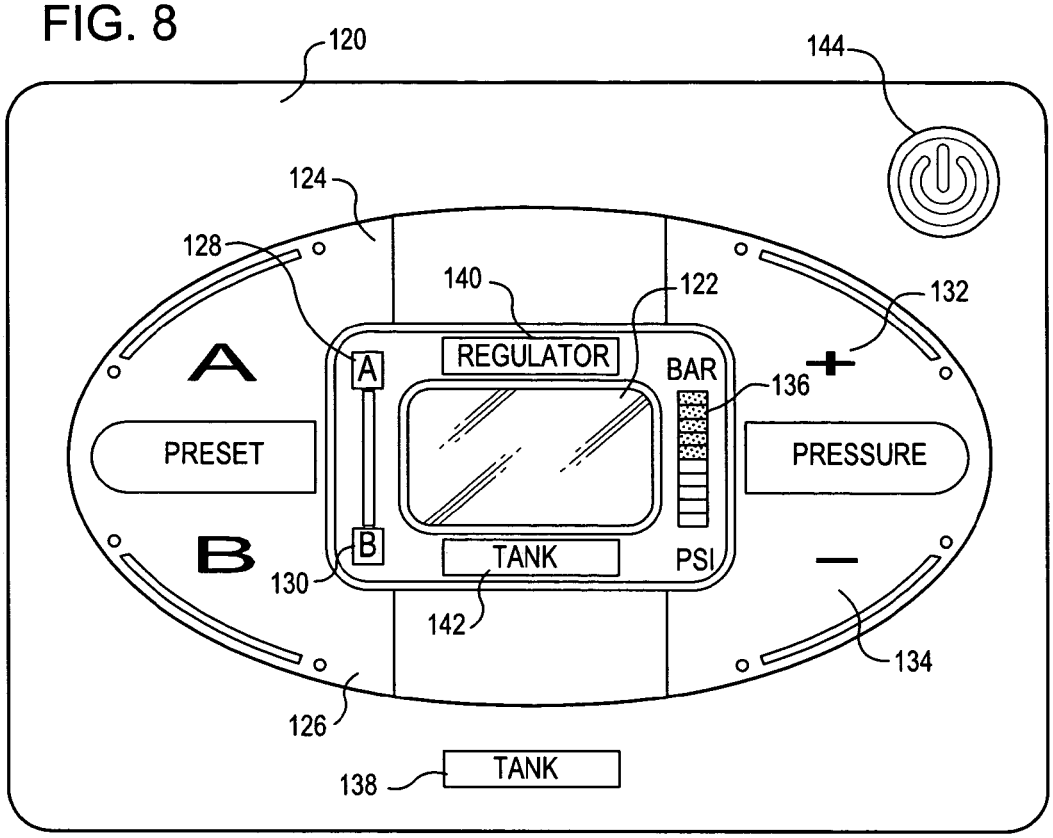
FIG. 8 is a user interface that may be used with the air compressor of FIG. 1 in accordance with an embodiment.

In accordance with an embodiment, the user interface 30 may include a digital gauge to replace conventional mechanical pressure gauges. As an example, a user interface 120 in accordance with an embodiment is shown in FIG. 8. The user interface 120 is connected to the controller 28 and provides appropriate signals in a manner known in the art of user interfaces.

The user interface 120 includes a digital display 122. In the embodiment shown, there are two preset buttons 124, 126. The preset buttons 124, 126 represent selected operating pressures at which the air compressor 20 may operate, for example one of the preset buttons 124 may represent operating the air compressor 20 so that the output pressure is 60 PSI. Selecting this preset button 124 results in the air compressor 20 operating at this air pressure. This button 124 may be used, for example, to set the operating pressure of the pneumatic controller 38. Alternatively, the preset button 124 may be used to set the operating pressure of the electronically simulated regulator 100, or another system that provides pressure for an air compressor such as the air compressor 20. As another example, a motor may be used to rotate the existing dial for conventional air compressors.

The second preset button 126 may represent a second pressure, such as 90 PSI, at which the air compressor 20 operates. These preset buttons 124, 126 may be set to particular pressures at a factory, and may be static, or may be changeable by a user, for example by pressing and holding one of the preset buttons 124, 126 at a particular pressure. Indicators 128, 130 may be provided to indicate that one of the preset pressures has been selected.

In the embodiment shown, pressure selector buttons 132, 134 are provided. The pressure selector button 132 allows a user to increase pressure of the air compressor 20, and the pressure selector button 134 allows the user to decrease pressure. A bar indicator 136 may be provided to indicate the existing selected operating pressure relative to minimums and maximums. A user may use the pressure selector buttons 132, 134 to set the operating pressure of the air compressor 20, for example via the pneumatic controller 38 or the electronically simulated regulator 100.

In accordance with an embodiment, the digital display 122 shows only one of the regulator pressure or the tank pressure, thus alleviating confusion for the user. For example, the default mode may be showing regulator pressure, and then a user may press a tank button 138 causing tank pressure to be displayed. The tank pressure may be displayed while the user is holding the tank button 138, or touching the tank button 138 may cause the display to toggle between regulator pressure to tank pressure. Holding the tank button 138 for a prolonged time (e.g., 3 seconds) may also cause the display to stay in tank pressure mode. If desired, indicators may be provided to indicate which pressure is being displayed, such as a regulator indicator 140 and a tank indicator 142. A power button 144 may also be provided on the user interface 120.

Figure 9:
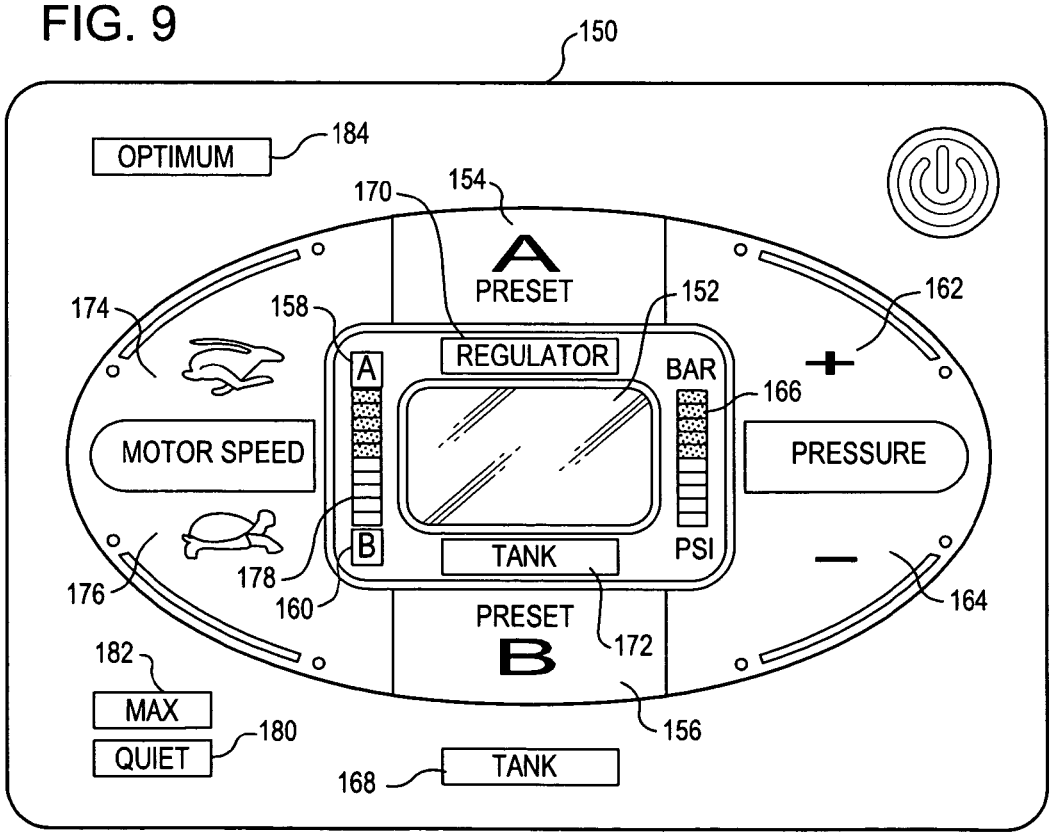
FIG. 9 is an alternate embodiment of a user interface that may be used with the air compressor.

A user interface 150 in accordance with another embodiment is shown in FIG. 9. The user interface 150 also includes a digital display 152, two preset buttons 154, 156 and associated indicators 158, 160, and pressure selector buttons 162, 164. A bar indicator 166 may also be provided for indicating a particular pressure, and a tank button 168 with associated regulator and tank indicators 170, 172 is also provided in the shown embodiment.

The user interface 150 also includes motor speed selection buttons 174, 176. These motor speed selection buttons 174, 176 allow the user to select a motor speed of the air compressor 20 in accordance with an embodiment. This embodiment is further described below. A bar indicator 178 may be provided for indicating the selected motor speed. In addition, buttons may be provided for particular operating modes of the motor. In the example shown, a quiet mode button 180, a maximum mode button 182, and an optimum mode button 184 are provided. Again, the functions of these buttons 180, 182, 184 are further described below.

The user interfaces 120 and 150, although provided as single panels, may be provided as multiple panels with the various components spread over the multiple panels. Thus, although each is shown as a single, "user interface" as used herein is meant to cover at least one, and perhaps multiple, interaction locations for a user.

In accordance with an embodiment, a variable speed motor 34 is provided for an air compressor, such as the air compressor 20. Generally described, the variable speed motor permits the pump 36 to operate at different speeds, and allows a variety of different operations for the motor, described below.

Figure 10:
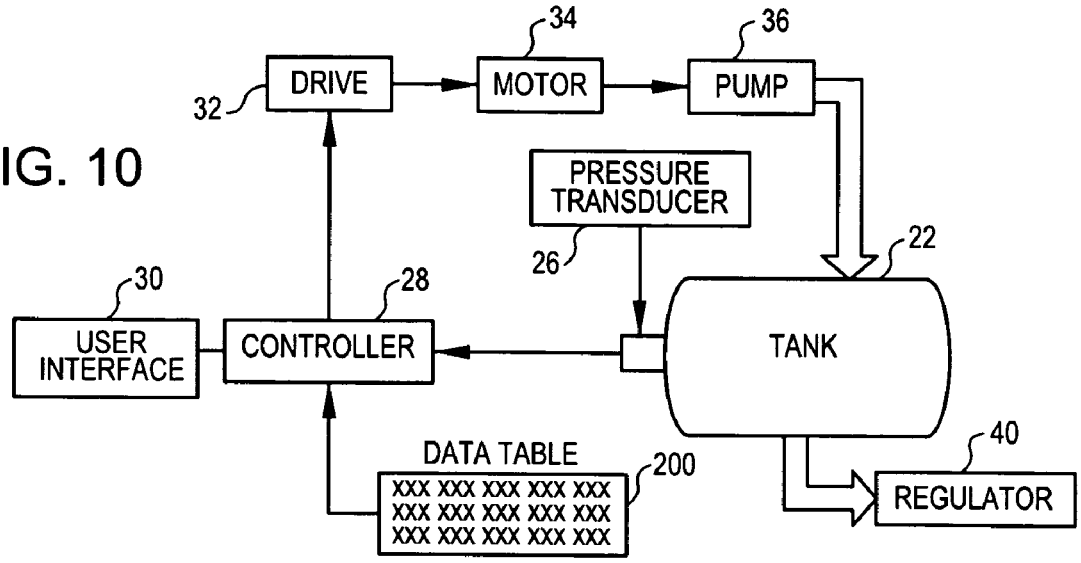
FIG. 10 is a diagrammatic view of components of an air compressor that may be utilized to provide a variable speed motor in accordance with an embodiment.

FIG. 10 shows an embodiment of internal components of the air compressor 20 that may be utilized to provide a variable speed motor, such as the motor 34. In the embodiment, the controller 28 communicates to the drive 32 that, in turn, controls the speed of the motor 34 and the pump 36. In this embodiment, a lookup table 200 is utilized in which pump and motor loading characteristics are mapped and loaded into the lookup table 200. The lookup table 200 may be used, for example, to drive the motor 34 at predetermined speeds based upon known loading characteristics of the pump 36 and the motor 34. The lookup table 200 may additionally or alternatively be used to set motor speeds based upon the operating pressure measured at the tank 22 by the pressure transducer 26. For example, if the pressure at the tank 22 is 100 PSI and the desired pressure is 120 PSI, the pressure transducer 26 signals to the controller 28 this pressure, and the controller 28 looks up the appropriate motor speed in the lookup table 200, and provides that information to the drive 32, which, in turn, instructs the motor 34 to operate at a particular speed. The speed for the motor 34 may also be determined based upon the desired and present output pressures of the air compressor 20, as is further described below.

Figure 11:
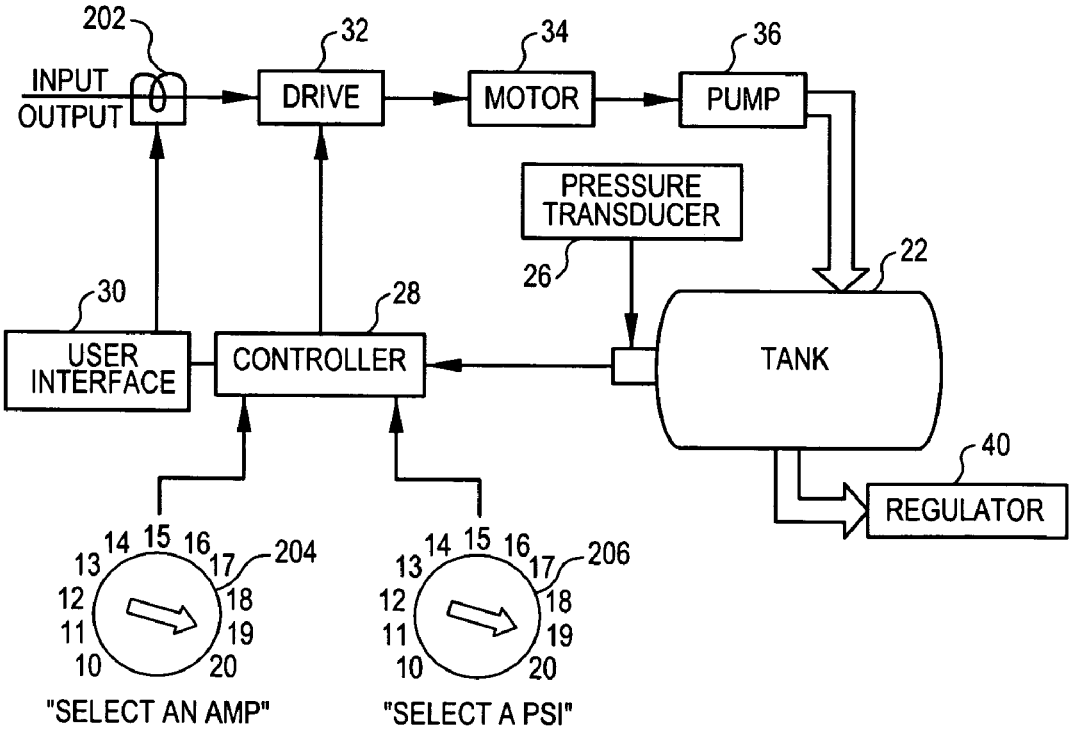
FIG. 11 is a diagrammatic view of an alternate embodiment of components of an air compressor that may be utilized to provide a variable speed motor.

A second embodiment of internal components for an air compressor such as the air compressor 20 having a variable speed motor 34 is shown in FIG. 11. In this embodiment, a current transducer 202 is utilized in the electrical supply circuit that measures current consumption. The current consumption may be, for example, used to drive the motor 34 and the pump 36 at the highest possible speeds without exceeding the limitations of the electrical circuit. The benefit of this system is that it compensates for manufacturing tolerances, and allows peak performance to be obtained from every machine.

In either embodiment, if desired, an amp selection switch 204 may be provided for permitting a user to set the speed of the motor 34 manually by setting the amount of amps the motor may draw. This may be done, for example, via the motor speed selectors 174, 176 on the user interface 150 in FIG. 9.

The amp selection switch 204 provides advantages over fixed speed air compressors. In conventional air compressors, the pump and motor are sized to provide the maximum possible air flow. This feature means that the pump and the motor are optimized to take full advantage of the electrical circuit that the air compressor is designed for. While this is desirable for many situations, there are occasions where limited power is available, and lower flow would be acceptable. An example of this is a construction application when power is first brought up to the job site and multiple electrical tools are run on a single circuit. A typical air compressor would overload the circuit if it required the full 15 amps available and another tool is in use at the same time on the same circuit.

Since the load on the motor (and hence the amperage required to run it) are proportional to speed, variable speed would permit the selection of lower maximum amperage with the appropriate controls. An example of the appropriate control would be amp selection switch 204.

Operating the air compressor 20 at lower amperage causes lower air flow for the pump 36. However, as described above, if the current transducer 202 is used, the controller 28 may be configured so that speed is varied to the motor 34 to keep amperage and horse power at a predetermined level that maximizes output of the compressor pump. In this manner, significantly higher air flows can be achieved at lower pressures. There is a slight sacrifice of performance at maximum load points of the machine caused by losses associated with the drive system. However, overall system performance is improved. Thus, although the pump 36 operates at lower amperage, the tank 22 may be filled faster, especially at lower loads. However, if the amperage is dialed down to a small enough number, it may take more time to fill the tank 22. Nevertheless, the air compressor 20 is still capable of operating with higher performance and utilizing less amperage.

If desired, the amp selection switch 204 may also be configured so that it may dial amperage up to higher than normal, such as 20 amps for newer home construction. This would permit a variable speed air compressor to be used on any circuit because the user could select the appropriate amperage.

Selecting the appropriate amperage also provides another benefit, in that the user may cause the air compressor 20 to run more quietly. As stated above, the slower the motor 34 runs, the more quiet the air compressor 20. Thus, the user may run the air compressor 20 in lower amperage to run the air compressor 20 in a more quiet operation. The user may do this through setting the motor 34 to a lower speed, such as via the motor speed selector buttons 174, 176 on the user interface 150, or by selecting a quiet mode by pressing the quiet mode button 180. The quiet mode button 180 may cause the air compressor 20 to run at a fixed amperage, such as at 10 amps, or may enable the motor speed selector buttons 174, 176 so that lower speeds of the motor may be used.

Another advantage of the use of a variable speed motor, such as the motor 34, is that the air compressor 20 may be set to operate at an optimal pressure. That is, the pressure for the tank 22 may be set to a pressure that is slightly above the pressure needed for a given tool. For example, if a tool needs 90 PSI, then the air compressor 20 may be configured to operate to maintain the tank 22 at 100 PSI. In this example, the system is configured so that as pressure in the tank 22 depletes and goes below the target, for example to 99 PSI, the motor 34 and pump 36 go faster. As the pressure in the tank 22 increases, the motor 34 is slowed until it reaches an upper, cut-out pressure, for example 101 PSI, at which the motor 34 will ultimately stop. This operation could result in achieving steady state where the motor 34 runs continuously at the appropriate speed for the task.

As usage changes, the speed would automatically change to match that of the use. An advantage of this system is that under conditions of intermittent use, the pump 36 could continue to run at lower speed overall, but still supply ample compressed air for the user.

If desired, to provide this function, a pressure selector switch 206 may be provided. This pressure selector switch may be selectable by the user, or may automatically be implemented when the compressor is operating in a particular mode, such as optimum mode. Optimum mode may be selected, for example, by pressing the optimum mode button 184, which may, for example, result in the motor 34 running at sufficient speeds to maintain the tank pressure at a given level, e.g., 5 PSI, above the desired output pressure. Optimum mode may also be automatically utilized by an air compressor such as the air compressor 20, or may be selected in another manner.

In optimum mode, if demand exceeds the capacity of the pump 36, the tank 22 will be depleted to a point where the pressure drops below the needed pressure for the tool. In this scenario, the controller 28 may set the motor 34 to operate at the maximum until desired pressure within the tank 22 is achieved.

Operating the compressor in the optimum mode permits the compressor to operate at a lower speed, which is typically much quieter, as described above. Thus, although the air compressor 20 will often run for longer periods of time, it will be at a lower speed, and thus at a much lower overall noise level.

In addition, faster speeds generally result in higher operating temperatures which shorten the life of an air compressor 20. Since the pump 36 displaces the same amount of air regardless of the speed, the piston would theoretically stroke the same number of times to produce a given quantity of compressed air. The fact that the piston is doing so at a slower speed to match use increases the usable life of the air compressor 20.

Figure 12:
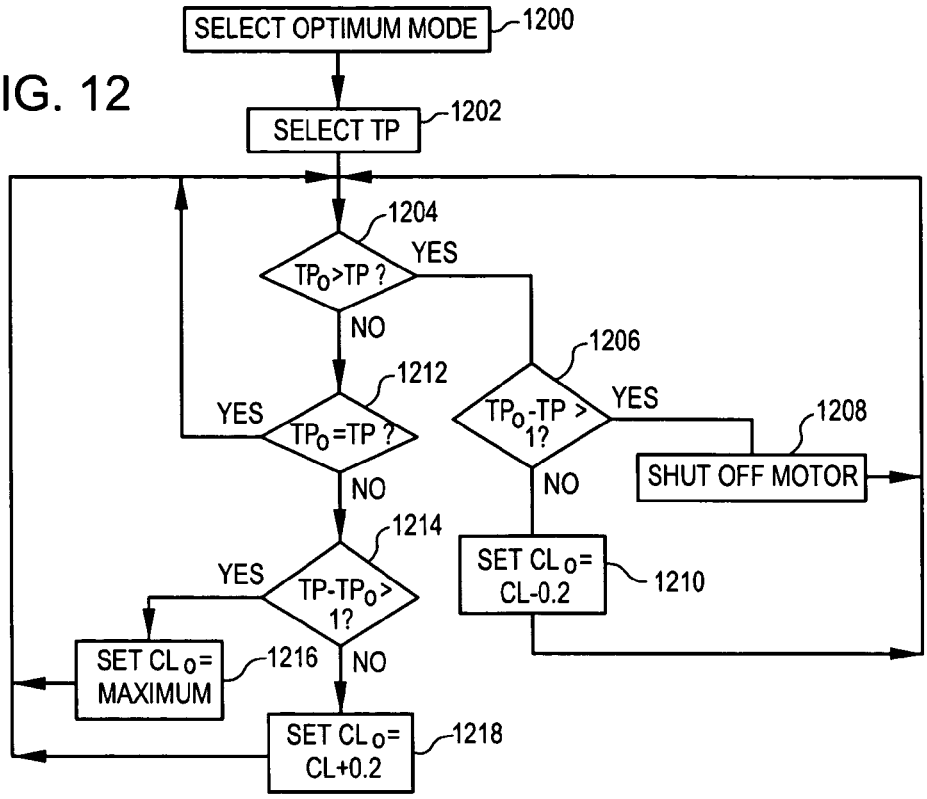
FIG. 12 is a flow chart generally showing steps for optimum mode of the air compressor in accordance with an embodiment of the invention.

FIG. 12 is a flow chart generally showing steps for optimum mode in accordance with an embodiment of the invention. Beginning at step 1200, a user selects optimum mode, for example by dialing in a tank pressure via the pressure selector switch 206, or by pressing the optimum mode button 184. The user then selects (if not already selected), or the air compressor automatically sets, the desired tank pressure TP (e.g., 100 PSI) at step 1202.

At step 1204, a determination is made whether the current tank pressure $TP_0$ is greater than the desired tank pressure TP. If so, step 1204 branches to step 1206, where a determination is made whether the current tank pressure $TP_0$ minus the desired tank pressure TP is greater than one (i.e., the current tank pressure $TP_0$ is greater than 101 in this example). If so, then step 1206 branches to step 1208, where the motor is shut off. The process then loops back to step 1204, where monitoring continues.

If the current tank pressure $TP_0$ minus the desired tank pressure TP is not greater than one, then the present current limit $CL_0$ is set to the previous current limit minus 0.2 AMPS at step 1210. This slows the motor in an effort to get the current tank pressure $TP_0$ back to the desired tank pressure TP. The process then loops back to step 1204.

If the current tank pressure $TP_0$ is not greater than the desired tank pressure TP, then step 1204 branches to step 1212, where a determination is made whether the desired tank pressure TP minus the current tank pressure $TP_0$ is greater than one (i.e., in this example, less than 99 PSI). If so, step 1214 branches to step 1216, where the present current limit $CL_0$ is set to maximum (i.e., the motor 34 is set to operate at maximum speed). The process then loops back to step 1204.

If the desired tank pressure TP minus the current tank pressure $TP_0$ is not greater than one, then step 1214 branches to step 1218, where the present current limit $CL_0$ is set to the previous current limit minus 0.2 AMPS (i.e., the motor 34 is slowed down. The process then loops back to step 1204.

To provide the operations herein, the controller 28, an electronic control system, or an electronic controller may be any device or mechanism used to regulate or guide the operation of the air compressor 20 and/or its components, and/or may be a device that utilizes computer-executable instructions, such as program modules. Generally, program modules include routines, programs, objects, components, data structures, and the like, that perform particular tasks or implement particular abstract data types. In addition, although a single controller 28 is described, more than one controller may be used for the operations described herein, and/or operations of the controller may spread over multiple controllers.

The controller 28 may also be configured to utilize predictive behavior so that the air compressor 20 may operate in a more efficient manner. Standard conventional fixed speed air compressors rely on a pressure switch with two set points, a cut-in and cut-out point, to control the on and off cycling of the motor. Due to limitations in the designs of these switches, they typically have a 25-30 PSI span within which the compressor operates. This means that as air is used in the tank, nothing will happen until the pressure drops below the lower set point or cut-in pressure. Likewise, once running, the motor will continue to run, full speed, until the upper set point or cut-out pressure is reached.

With the use of the variable speed motor 34, since the pressure transducer 26 measures and reports the pressure in the tank 22 over an infinite scale, predictive behavior can be part of the logic controlling the system. For example, if air pressure is dropping rapidly due to high use, the motor 34 can come on at full speed long before the traditional cut-in pressure is reached to try to counteract the depleting supply of pressurized air. Likewise, if the tank pressure is only dropping slowly, the machine may run at a slower speed to increase the pressure.

Figure 13:
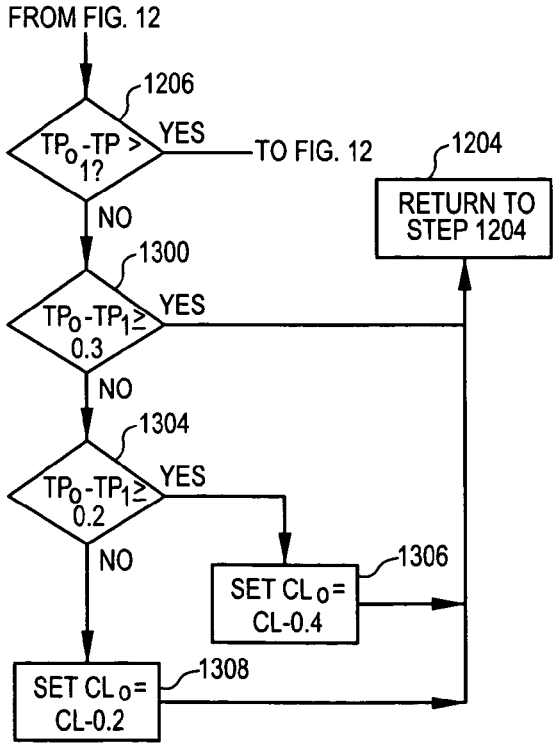
FIG. 13 is a flow chart generally showing steps for using predictive behavior in operation of an air compressor in accordance with an embodiment of the invention.

FIG. 13 is a flow chart generally showing steps for using predictive behavior in accordance with an embodiment of the invention. Using step 1206 as an example, if the current tank pressure $TP_0$ minus the desired tank pressure TP is not greater than one, then instead of branching to step 1210, the process branches to steps 1300-1308, where predictive behavior is used. If the current tank pressure $TP_0$ minus the just previous tank pressure $TP_1$ is greater than or equal to 0.3 PSI, then the present current limit $CL_0$ is set to the previous current limit CL minus 0.6 AMPS at step 1302. The process then loops back to step 1204.

If the current tank pressure $TP_0$ minus the just previous tank pressure $TP_1$ is less than 0.3 PSI, then step 1300 branches to step 1304, where a determination is made whether the current tank pressure $TP_0$ minus the just previous tank pressure $TP_1$ is greater than or equal to 0.2 PSI. If so, step 1304 branches to step 1306, where the present current limit $CL_0$ is set to the previous current limit CL minus 0.4 AMPS. The process then loops back to step 1204.

If the current tank pressure $TP_0$ minus the just previous tank pressure $TP_1$ is less than 0.2 PSI, then step 1304 branches to step 1308, where the present current limit $CL_0$ is set to the previous current limit CL minus 0.2 AMPS. The process then loops back to step 1204.

As can be seen by the process in FIG. 13, the speed of the motor 34 is incremented more if the change in pressure is greater. In this manner, the motor speed may react according to the load on the motor. The motor speed may similarly be adjusted if the pressure in the tank is lowering. The changes in motor speed in FIG. 13 are one example, and the motor speed changes may be more or less dramatic, and do not have to be linear with respect to pressure changes.

Use of a variable speed motor 34 provides another benefit. Induction motors, especially those with high speed horsepower ratings, draw an extraordinary amount of power when starting. For example, a two (2) peak horsepower induction motor will typically draw in excess of 100 amps until the motor gets up to speed and settles in at the normal operating conditions of less than 15 amps. Circuit breakers and some special fuses are designed for this initial inrush of current, although the conditions may be marginal, the result is often tripping of a circuit breaker or blowing of a fuse.

Using a variable speed motor such as the motor 34, an air compressor such as the air compressor 20 can be brought up to speed slowly over the first second or seconds of operation, limiting the maximum current drawn from the circuit. Given the system described earlier, using a current transducer such as the current transducer 202 would ensure that the starting current never exceeds a certain amount, such as 200% of the user-selected operating current.

Figure 14:
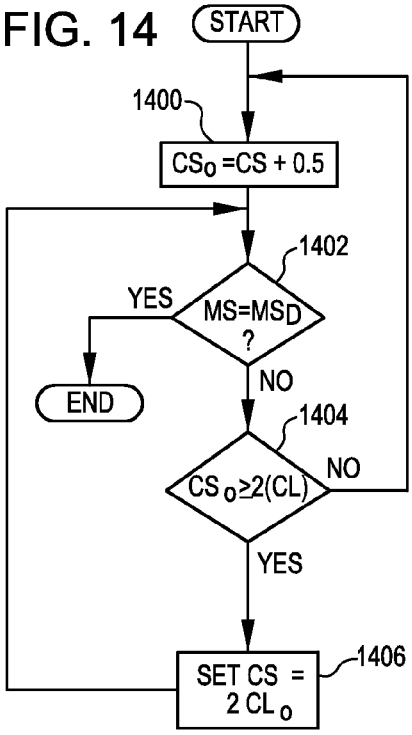
FIG. 14 is a flow chart generally showing steps for bringing the motor slowly up to speed in accordance with an embodiment of the invention.

FIG. 14 is a flow chart generally showing steps for bringing the motor slowly up to speed in accordance with an embodiment of the invention. First, the motor 34 is started. Then, at step 1400, the current supplied $CS_0$ to the motor is set to 0.5 AMPS plus the previous current supplied CS. At step 1402, a determination is made whether the current motor speed MS is equal to the desired motor speed $MS_D$. If so, the process ends, and the motor 34 operates as normal. If not, then step 1402 branches to step 1404, where a determination is made whether the current supplied $CS_0$ is greater than or equal to two times the user-selected current CL. If not, the process returns to step 1400, where the current is incremented again. If so, then step 1404 branches to step 1406, where the current supplied $CS_0$ is set to two times the user-selected current CL. The process then branches back to step 1402, awaiting the motor speed to reach the desired motor speed.

Another advantage that may be provided by a variable speed motor is that the unloader valve in the pump may be eliminated. Conventional air compressors today include an unloader valve. This valve is used to bleed off the compressed air in the pump head when the air compressor shuts off, so that it does not have to restart under load. The reason that this unloading of the compressed air is needed is that single phase induction motors typically have low starting torque, and high starting amperage requirements as set forth above.

Using a variable speed motor eliminates the need for the unloader valve. Most variable speed motors, which are three phase motors, have substantially higher levels of starting torque such that they would be capable of starting under load. Also, the drive 32 can limit in-rush current as described earlier so tripping the circuit breakers can be eliminated. Finally, the drive 32 can be set to boost voltage at the motor during startup to further increase starting torque.

Eliminating the unloader valve saves money because of reduced parts. In addition, eliminating the unloader valve removes several potential leak points in some components that are often prone to fail over time.

In accordance with an embodiment, tools are provided that may send a coded signal or other information to an air compressor, such as the air compressor 20. The coded signal includes information about the desired operation of the air compressor 20 for the particular tool. The air compressor 20 may utilize this information to operate as requested, for example at an appropriate pressure and/or motor speed for operation of the particular tool.

Figure 15:
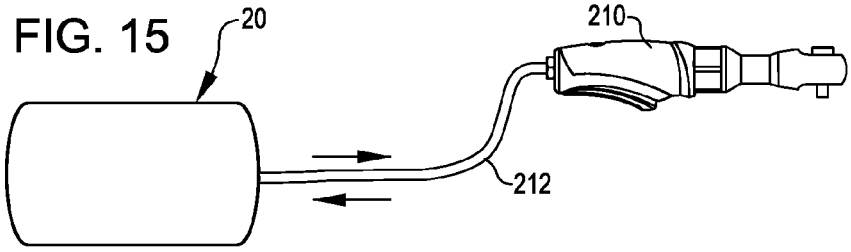
FIG. 15 is a diagrammatic example of a tool and an air compressor wherein the tool provides information to the air compressor in accordance with an embodiment of the invention.

An example of such a tool 210 is shown in FIG. 15. In accordance with an embodiment, the tool 210 is configured to send a signal to the air compressor 20. If desired, the tool 210 may send the signal to the air compressor 20 via a wireless signal, such as an infrared signal or radio frequency signal. Alternatively, the tool 210 may include a key that is removed from the tool 210 and is attached to the air compressor 20 so that information about desired operation for the particular tool 210 may be provided to the air compressor 20. Other mechanisms may be used to transfer the information from the tool 210 to the air compressor 20.

Figure 16:
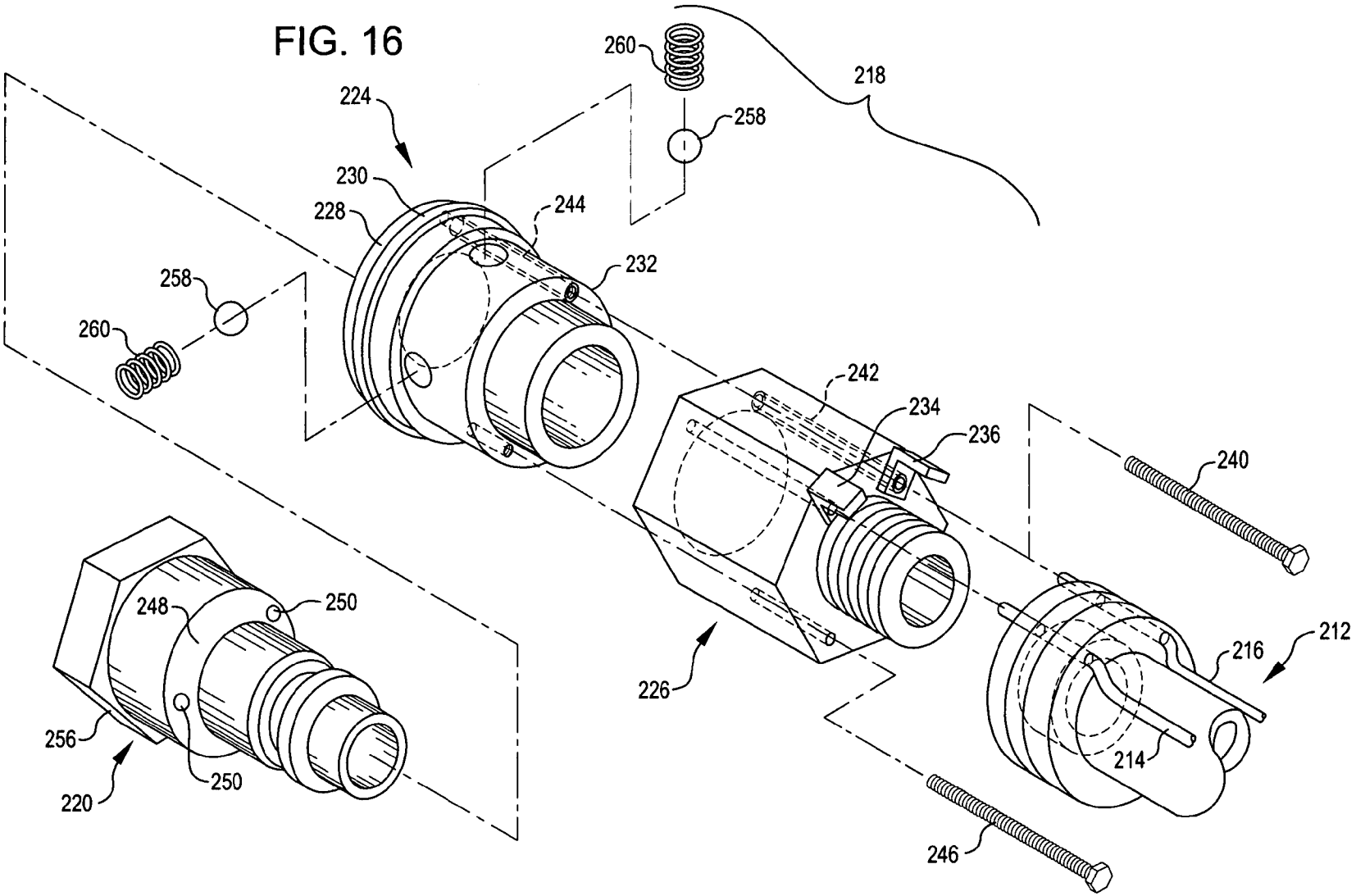
FIG. 16 is an exploded view of an end of a hose for connecting the tool of FIG. 15 with a compressor, the end including a coupler in accordance with an embodiment of the invention.

In accordance with an embodiment, a signal carrying pneumatic hose 212 (FIG. 15) is provided for sending a coded signal from the tool 210 to the air compressor 20. As can be seen in FIG. 16, the signal carrying pneumatic hose 212 includes a neutral wire 214 and a hot wire 216 running along its length. In an embodiment, each end of the signal carrying pneumatic hose 212 includes a coupler 218. Each of these couplers 218 may be configured in an embodiment to fit on conventional plugs, such as quarter-inch male plugs that are typically provided on air compressors and air compressor tools. Such a conventional plug 220 is shown in FIG. 16.

The coupler 218 shown in the drawings includes a lead portion 224 and an aft portion 226. The lead portion 224 includes a metal plate 228 at a front end separated by an insulating layer 230 from the main body 232 of the lead portion 224.

Two connectors 234, 236 are provided on the back portion of the aft portion 226. The first connector 234 connects to the neutral wire 214, and causes the majority of the coupler 218 to be grounded to the neutral wire 214. The second connector 236 connects to a screw 240 that extends through an insulating sleeve 242 in the aft portion 226 and a second insulating sleeve 244 in the lead portion 224. The screw 240 attaches to the metal plate 228. Thus, the hot wire 216 is connected directly to the metal plate 228, which is insulated from the remainder of the coupler 218. One or more additional screws, such as the screw 246, may be provided for attaching the aft portion 226 to the lead portion 224. These additional screws, such as the screw 246, ensure that the aft portion 226 and the lead portion 224 are grounded together with the neutral wire 214.

Figure 18:
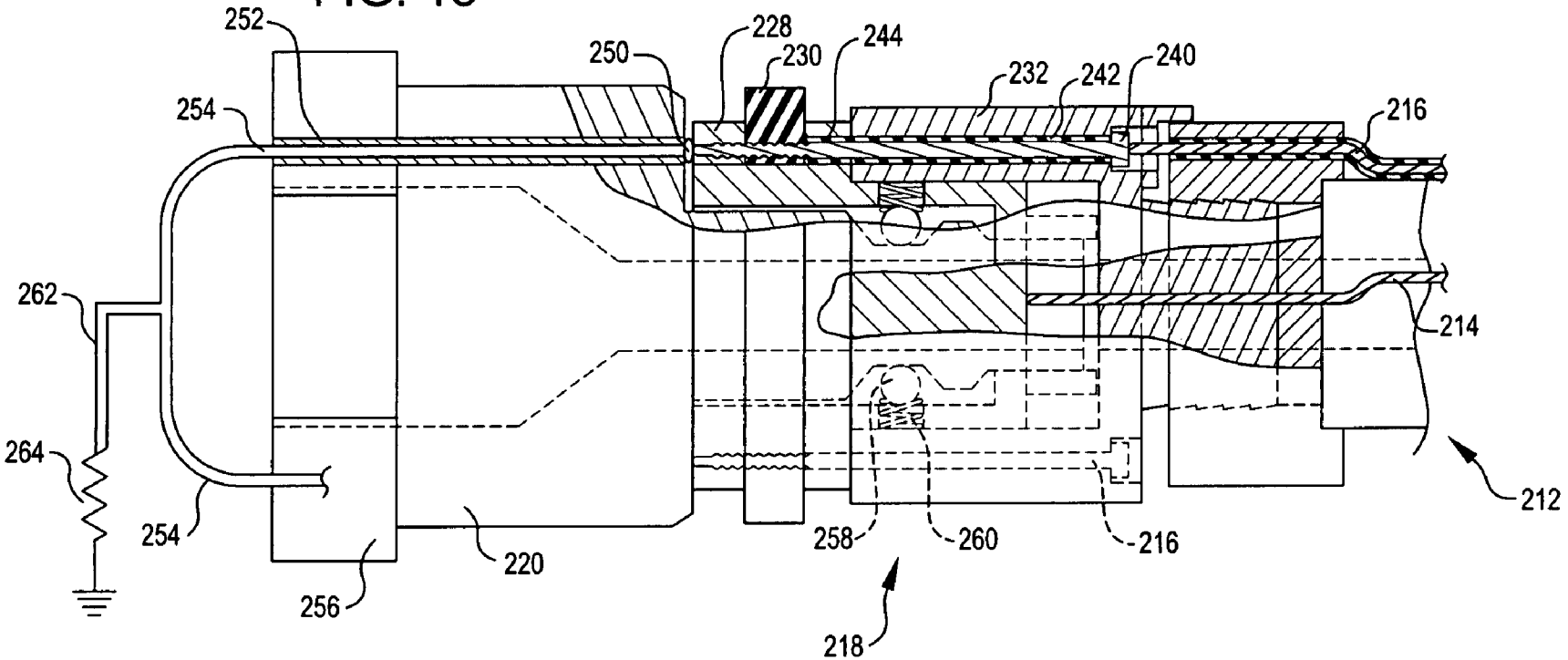
FIG. 18 is a sectional view taken along the section lines 18-18 of FIG. 17.

A shoulder 248 of the plug 220 includes one or more contacts 250. These contacts 250 are arranged to engage the metal plate 228 of the coupler 218. As can be seen in FIG. 18, an insulating sleeve 252 leads from the contacts 250 and includes a wire 254. This wire 254 is connected to the base 256 for the plug 220, which, in turn, is electrically connected to the internal portion of the coupler 218. Thus, the base 256 is grounded with the neutral wire 214 when the plug 220 is attached to the coupler 218. Grounding of the plug 220 to the coupler 218 may be assured by a friction fit, or by conventional ball-and-spring connectors 258, 260, which are known in the plug and coupler art.

A second wire 262 is connected to the wire 254, and is connected, for example via a ground, to the base 256 of the plug 220. A resistor 264 is positioned on this wire 262, and thus in series with the wire 254. The resister 264 may alternatively be in the wire 254. In either event, the resistor 264 changes the current flow through the wire 254, and thus returned to the air compressor 20, based upon the resistance of the resistor 264. That is, a base voltage (e.g., 5 V) or current is provided through the hot wire 216 and is returned through the connection of the wire 254, but the current is reduced a particular amount by the resistor 264. Based upon this current change, the air compressor 20 may utilize the particular current, for example via a lookup table, to provide an appropriate pressure and/or motor speed for the air compressor 20.

As can be understood, different tools may include different resistors 264 so that appropriate pressures and/or motor speeds may be provided for a particular tool. Thus, a user does not have to select a particular pressure and/or motor speed, but instead the air compressor 20 is provided information by a tool so that the air compressor 20 will automatically function at the proper pressure and/or speed.

As described earlier, other mechanisms may be provided on the tools 210 for providing the signal to the air compressor 20. However, the embodiment described is a simple, inexpensive mechanism that can provide this information to the air compressor 20.

In accordance with an embodiment, a signal provided by a tool, such as the tool 210, to the air compressor 20 may be variable at the tool. Such a feature would permit a user to "dial in" a desired pressure and/or motor speed. For example, if a nailer is being used, and additional pressure is desired, the user may increase the pressure by changing the signal sent by the tool 210. Alternatively, if decreased pressure is needed, the user may dial the decreased pressure setting into the tool.

An embodiment of a plug 270 providing a variable signal is shown in FIG. 19. The plug 270 includes a dial 272 having a rheostat or another structure for regulating a current by means of variable resistances. The plug 270 includes a circuit similar to the circuit described with reference to FIG. 17, but instead of a fixed series resistor, the plug 270 includes a rheostat connected to the dial 272. The user may rotate the dial 272 to vary the resistance provided by the rheostat in a manner known in the art. As such, the coded signal provided by the tool 210 may be selected by a user.

Although disclosed in FIG. 18 as being connected to the plug 270, a device for providing a variable signal to the air compressor 20 by the tool 210 may be provided at any location on the tool 210, and the variable signal provided may be a signal other than changed resistance. As nonlimiting examples, the tools may include a dial located at a different location on the tool, may include a user interface including a digital display for providing such a variable signal, or may utilize some other mechanical means for providing a variable signal. However, the embodiment shown in FIG. 18 is useful in that it is inexpensive to produce, and provides a simple mechanism for varying the signal providing by the tool 210.

The signal provided by the tool 210 may be utilized by the controller 28 to change the pressure and/or motor speed operation of the air compressor 20. For example, the operation may be changed in accordance with many of the embodiments described above or may be changed in another manner.

Figure 20:
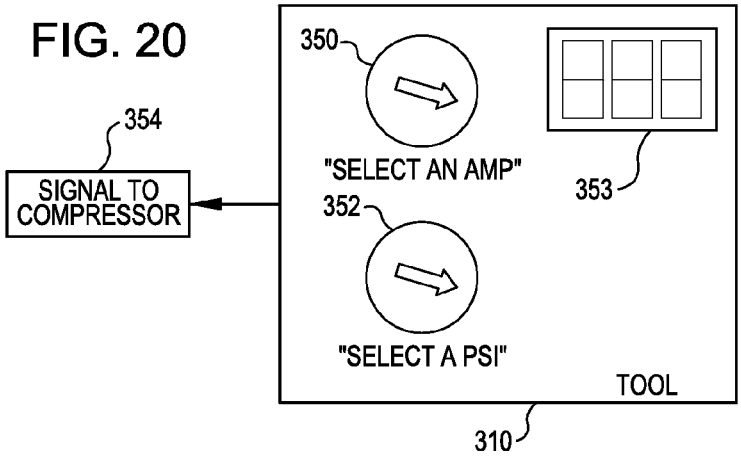
FIG. 20 is a diagrammatic representation of a variable signal generator in accordance with an alternate embodiment.

An alternate example is shown in FIG. 20, where the tool 210 includes an amp selector 350, a PSI selector 352, and a display 353. A user selects a desired motor speed via the amp selector 350 and/or a desired operating pressure via the PSI selector, and a signal 354 is sent to the air compressor 20, for example via the signal carrying pneumatic hose 212 or a wireless connection. The tool may alternatively include just the amp selector 350 or the PSI selector 352, or may include other user interface selections for selecting a desired operation of the air compressor 20.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An air compressor, comprising:

a drive unit for generating compressed air;

a coupler for connecting the air compressor to one of a plurality of different air compressor air tools;

a receiver for receiving operating information particular to that air compressor air tool from the connected air compressor air tool; and a controller for setting operation of the air compressor in accordance with the information.

2. The air compressor of claim 1, wherein the receiver is a wireless receiver.

3. The air compressor of claim 1, wherein the receiver is configured to receive the information from a signal carrying pneumatic hose.

4. The air compressor of claim 1, further comprising a variable speed motor, and wherein the operating information comprises a setting for speed of the motor.

5. The air compressor of claim 1, wherein the operating information comprises a setting for output pressure of the air compressor.

6. The air compressor of claim 1, wherein the air compressor comprises a tank for receiving the compressed air and the operating information comprises a setting for tank pressure of the air compressor.

7. The air compressor of claim l, the coupler further comprising a plug for attaching a signal carrying pneumatic hose, and wherein the plug comprises at least one electrical contact for receiving the information.

8. The air compressor of claim 7, wherein the plug comprises two electrical contacts, a first contact electrically connected to the plug and a second contact electrically insulated from the plug.

9. The air compressor of claim 1, wherein the controller is configured to access a lookup table and upon receiving the information, accessing operating conditions for the air compressor via the lookup table.

10. The air compressor of claim 1, wherein the air compressor presents a base voltage potential via a first wire extending between the air compressor and the connected air tool to the connected air compressor air tool, and wherein the receiver comprises a device for receiving a current signal from a second wire extending between the air compressor and the air compressor air tool as a result of the base voltage potential being presented at the connected air compressor air tool, the first and second wires being electrically connected to form a circuit, and the information comprises an electrical resistance in the connected air compressor air tool which is in electrical communication with at least one of the first wire and the second wire that causes a measurable reduction in an electrical current flowing from the air compressor through the first and second wires and returning to the receiver.

11. An air compressor, comprising:

a drive unit for generating compressed air;

a tank for receiving the generated compressed air, a coupler and hose for connecting the tank of the air compressor to one of a plurality of different air compressor air tools, each air tool containing an operating information relating to that particular air tool;

a receiver for receiving the operating information from the connected air compressor air tool; and a controller for setting operation of the air compressor in accordance with the information.

12. The air compressor of claim 11, wherein the coupler and hose comprise wires for transmitting an electrical current from the air compressor to the air compressor air tool and returning the current to the air compressor, and an electrical resistance located at the air tool and in electrical communication with the wires to change the current from the air compressor before it is returned to the air compressor.

13. The air compressor of claim 12, wherein the electrical resistance at the connected air compressor air tool is fixed.

14. The air compressor of claim 12, wherein the electrical resistance at the connected air compressor air tool is variable and adjustable by a user.

15. The air compressor of claim 11, wherein the operating information comprises a key removable from the connected air compressor air tool and attached to the air compressor.

16. The air compressor of claim 11, wherein the operating information comprises a signal transmitted by one of infrared and radio frequency.

* * * * *